US008152436B2

(12) United States Patent
Glasspoole et al.

(10) Patent No.: US 8,152,436 B2
(45) Date of Patent: Apr. 10, 2012

(54) BLADE UNDER PLATFORM POCKET COOLING

(75) Inventors: David F. Glasspoole, St. Lambert (CA); François Caron, Longueuil (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 1129 days.

(21) Appl. No.: 11/970,830

(22) Filed: Jan. 8, 2008

(65) Prior Publication Data

US 2009/0175732 A1 Jul. 9, 2009

(51) Int. Cl.

| | |
|---|---|
| ***F01D 9/06*** | (2006.01) |
| ***F01D 5/08*** | (2006.01) |
| ***F01D 5/18*** | (2006.01) |

(52) U.S. Cl. ..... 415/1; 415/115; 415/173.1; 416/1; 416/95; 416/96 R; 416/97 R; 416/193 A

(58) Field of Classification Search ..... 415/1, 115, 415/173.7; 416/1, 95, 96 R, 96 A, 97 R, 416/193 A See application file for complete search history.

(56) References Cited

U.S. PATENT DOCUMENTS

| | | | | |
|---|---|---|---|---|
| 2,915,279 | A * | 12/1959 | Chamberlin | 416/97 R |
| 4,247,257 | A * | 1/1981 | Benoist et al. | 416/95 |
| 4,425,079 | A | 1/1984 | Speak et al. | |
| 4,457,668 | A | 7/1984 | Hallinger | |
| 4,820,116 | A | 4/1989 | Hovan et al. | |
| 4,822,244 | A | 4/1989 | Maier et al. | |
| 4,854,821 | A * | 8/1989 | Kernon et al. | 416/95 |
| 5,639,216 | A | 6/1997 | McLaurin et al. | |
| 5,800,124 | A * | 9/1998 | Zelesky | 416/95 |
| 6,071,075 | A | 6/2000 | Tomita et al. | |
| 6,120,249 | A | 9/2000 | Hultgren et al. | |
| 6,190,130 | B1 | 2/2001 | Fukue et al. | |
| 6,196,791 | B1 | 3/2001 | Tomita et al. | |
| 6,196,799 | B1 | 3/2001 | Fukue et al. | |
| 6,290,464 | B1 | 9/2001 | Negulescu et al. | |
| 6,309,175 | B1 | 10/2001 | Hahnle et al. | |
| 6,416,284 | B1 | 7/2002 | Demers et al. | |
| 6,945,749 | B2 | 9/2005 | De Cardenas | |
| 7,758,309 | B2 * | 7/2010 | Bolms et al. | 416/96 R |
| 2005/0201857 | A1 * | 9/2005 | Ferra et al. | 415/115 |

FOREIGN PATENT DOCUMENTS

EP 1614861 A1 * 1/2006

* cited by examiner

*Primary Examiner* — Christopher Verdier

(74) *Attorney, Agent, or Firm* — Norton Rose Canada LLP

(57) ABSTRACT

Inlets are provided at a front end of inter-blade cavities for allowing coolant to flow therein to cool down the undersurface of the blade platforms as well as the rim of the disc of a rotor assembly.

15 Claims, 4 Drawing Sheets

BLADE UNDER PLATFORM POCKET COOLING

TECHNICAL FIELD

The invention relates generally to gas turbine engines and, more particularly, to a scheme for cooling the underside of turbine blade platforms as well as the periphery of the disc carrying the turbine blades.

BACKGROUND OF THE ART

Problems can arise when hot combustion gases flowing through the turbine section of a gas turbine engine leak through the gap between adjacent blade platforms into inter-blade pockets or cavities defined between the rotor disc periphery and the undersurface of the blade platforms. The high temperature of the combustion gases can cause damages to the rotor components located beneath the blade platforms.

It is know to use seals spanning these inter-platform gaps underneath the blade platforms to limit migration of hot gases into the inter-blade cavities. However, even with the addition of such seals, it has been found that the high temperature gases still leak into the inter-blade cavities.

Accordingly, there is a need to further limit the ingestion of high temperature gases from the main engine gaspath into the inter-blade cavities.

SUMMARY

In one aspect, there is provided a turbine rotor comprising: a disc mounted for rotation about and axis, said disc having axially spaced-apart front and rear faces and a rim extending circumferentially between said front and rear faces; a circumferential array of turbine blades extending radially outwardly from the rim of the disc, each turbine blade having a platform, an airfoil portion extending from a gaspath side of the platform, and a root portion depending from an undersurface of the platform opposite the gaspath side, the root portion of each of the turbine blades being received in a corresponding slot defined in the rim of the disc each pair of adjacent slots being separated by a peripheral land; and a circumferential array of inter-blade cavities defined between the undersurface of the platforms and the peripheral lands of the rim, each of the inter-blade cavities having a substantially closed upstream end in fluid flow communication with an inlet defined between the disc and the blades for channeling a flow of coolant from the front face to the rear face of the disc through said inter-blade cavities.

In a second aspect, there is provided a turbine section of a gas turbine engine comprising a forward stator assembly and a rotor assembly; the rotor assembly having a disc mounted for rotation about an axis and a plurality of circumferentially distributed blades extending radially outwardly from the disc into a working fluid gaspath; a front leakage path leading to the working fluid gaspath defined between the forward stator assembly and the rotor assembly; each blade being provided with a platform having an undersurface disposed in opposed facing relationship with a radially outwardly facing rim surface of the disc; and inter-blade cavities defined between the undersurface of the platforms of adjacent blades and the radially outwardly facing rim surface of the disc, each of the inter-blade cavities having a substantially closed upstream end with an inlet in fluid flow communication with the front leakage path for admitting a restricted portion of a coolant flow fed into the front leakage path into the inter-blade cavities, and an outlet for discharging the coolant flow passing through the inter-blade cavities in at least one of the working fluid gaspath and a rear side of the rotor assembly.

In a third aspect, there is provided a method of cooling a turbine section having a stator assembly disposed to direct a flow of hot gases to a rotor assembly having a series of blades extending radially outwardly from a rotor disc into a gaspath of said hot gases, said blades having platforms defining a radially inner boundary of the gaspath, the method comprising: providing a first cooling flow to purge a first space between the stator assembly and the rotor assembly from said hot gases, providing a second cooling flow to cool said stator assembly, cooling the platforms and a periphery of the rotor disc by directing a combined portion of said first and second cooling flows from a front side of said disc to a rear side thereof through inter-blade cavities defined between an undersurface of the platforms and the periphery of the rotor disc. At least a portion of the cooling flow passing through the inter-blade cavities is used to supplement a third cooling flow purging a second space on the rear side of the rotor disc.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
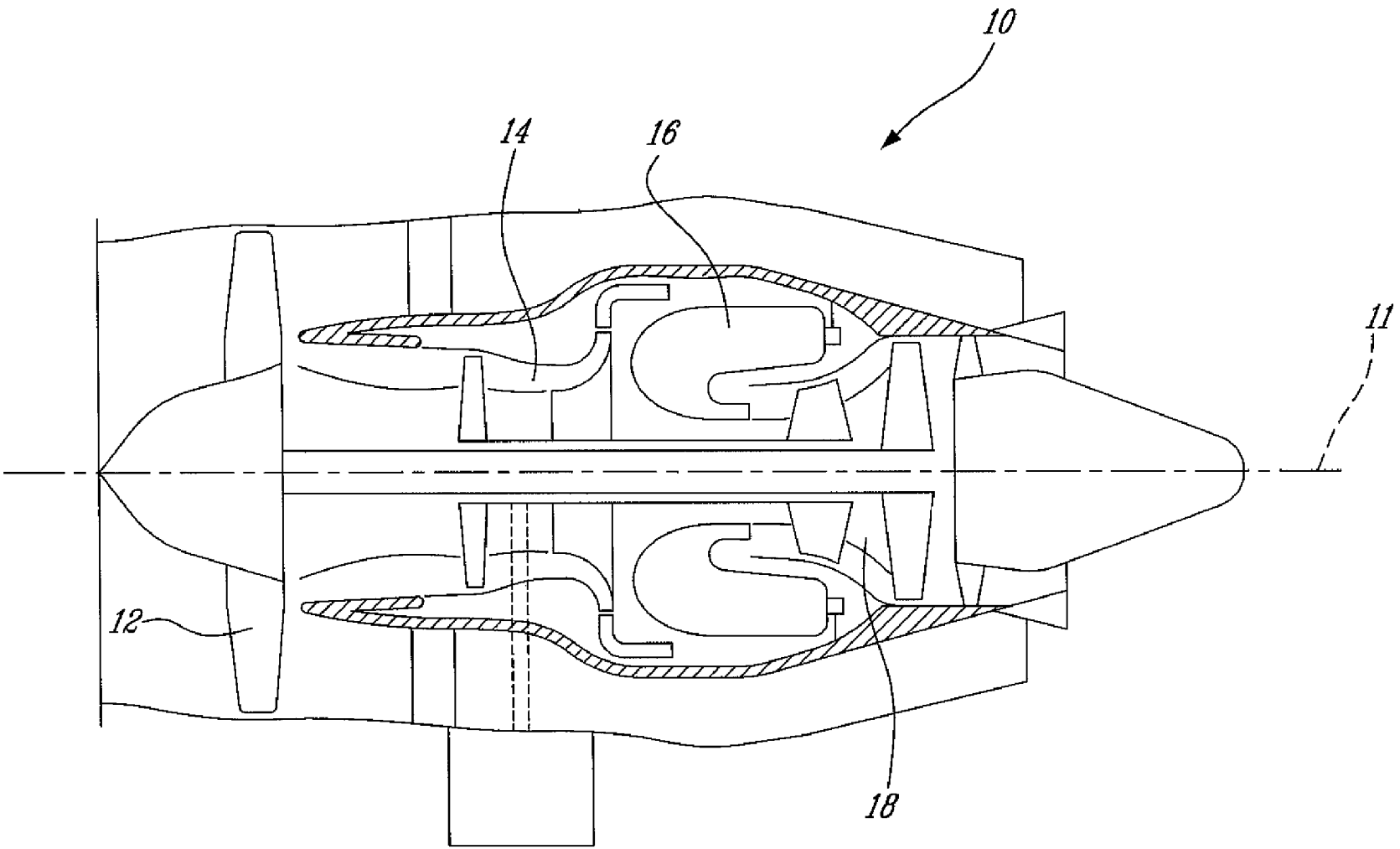
FIG. 1 is a schematic side view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
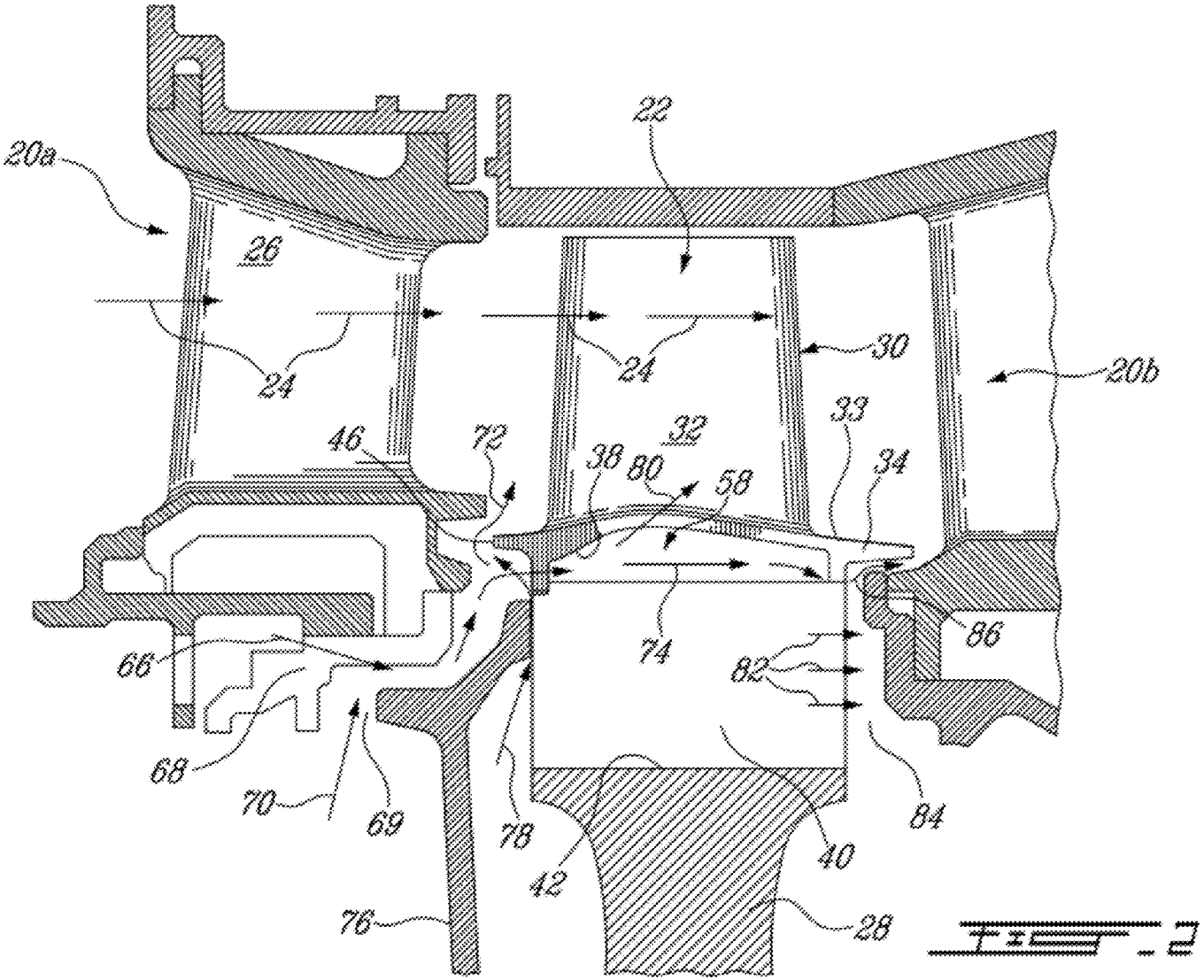
FIG. 2 is an axial cross-sectional view of a turbine section of the gas turbine engine.

FIG. 2 illustrates in further detail the turbine section 18 which comprises among others a first stator assembly 20*a*, a rotor assembly 22 and a second stator assembly 20*b* downstream of the rotor assembly 22. It is understood that the turbine section 18 can include multiple stator and rotor stages. A gaspath indicated by arrows 24 for directing the stream of hot combustion gases axially in an annular flow is generally defined by the stator and rotor assemblies 20*a*, 20*b* and 22. The first stator assembly 20*a* directs the combustion gases towards the downstream rotor assembly 22 by a plurality of nozzle vanes 26, one of which is depicted in FIG. 2. The rotor assembly 22 includes a disc 28 drivingly mounted to the engine shaft (not shown) for rotation therewith about the centerline axis 11 of the engine 10. The disc 28 carries at its periphery a plurality of circumferentially distributed blades 30 that extend radially outwardly into the annular gaspath 24, one of which is shown in FIG. 2.

Figure 3:
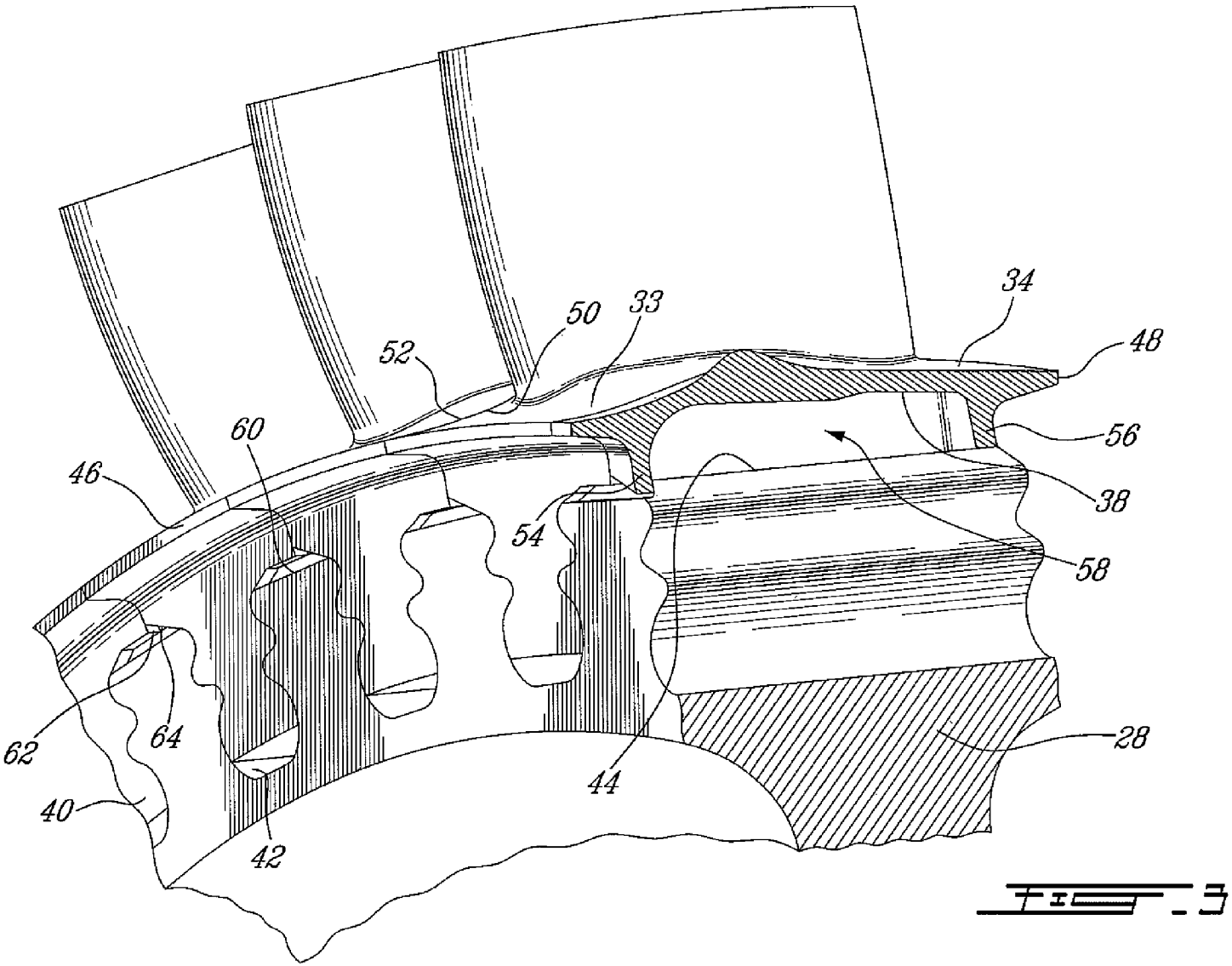
FIG. 3 is a front isometric view of a portion of a rotor assembly of the turbine section shown in FIG. 2.

Referring concurrently to FIGS. 2 and 3, it can be seen that each blade 30 has an airfoil 32 extending radially outwardly from a radially outwardly facing upper surface 33 of a platform 34. The radially outwardly facing surfaces 33 of the platforms 34 collectively form a radially inner boundary of the gaspath 24. Each blade 30 further comprises a shank 36 depending from an opposite radially inwardly facing undersurface 38 of the platform 34. The shank 36 merges into a root 40 which is captively received into a corresponding one of a plurality of circumferentially distributed axial slots 42 defined in the outer periphery or rim 44 of the rotor disc 28. The root 40 can be formed in a fir tree configuration that cooperates with mating serrations in the blade attachment slot 42 to resist centrifugal dislodgement of the blade 30. Other suitable complementary interlocking slot and root configurations or blade fixing arrangements could be used in order to retain the blades 30 on the disc 28.

The blade platform 34 extends axially from an upstream or front edge 46 to a downstream or rear edge 48 between opposed longitudinal side edges 50 and 52. A front or upstream rail 54 extends radially inwardly from the undersurface 38 of the blade platform 34 to interface with the disc rim 44 when the blade 30 is installed on the disc 28. Similarly, a rear or downstream rail 56 extends radially inwardly from the undersurface 38 of the platform 34 to interface with the disc rim 44.

Figure 4:
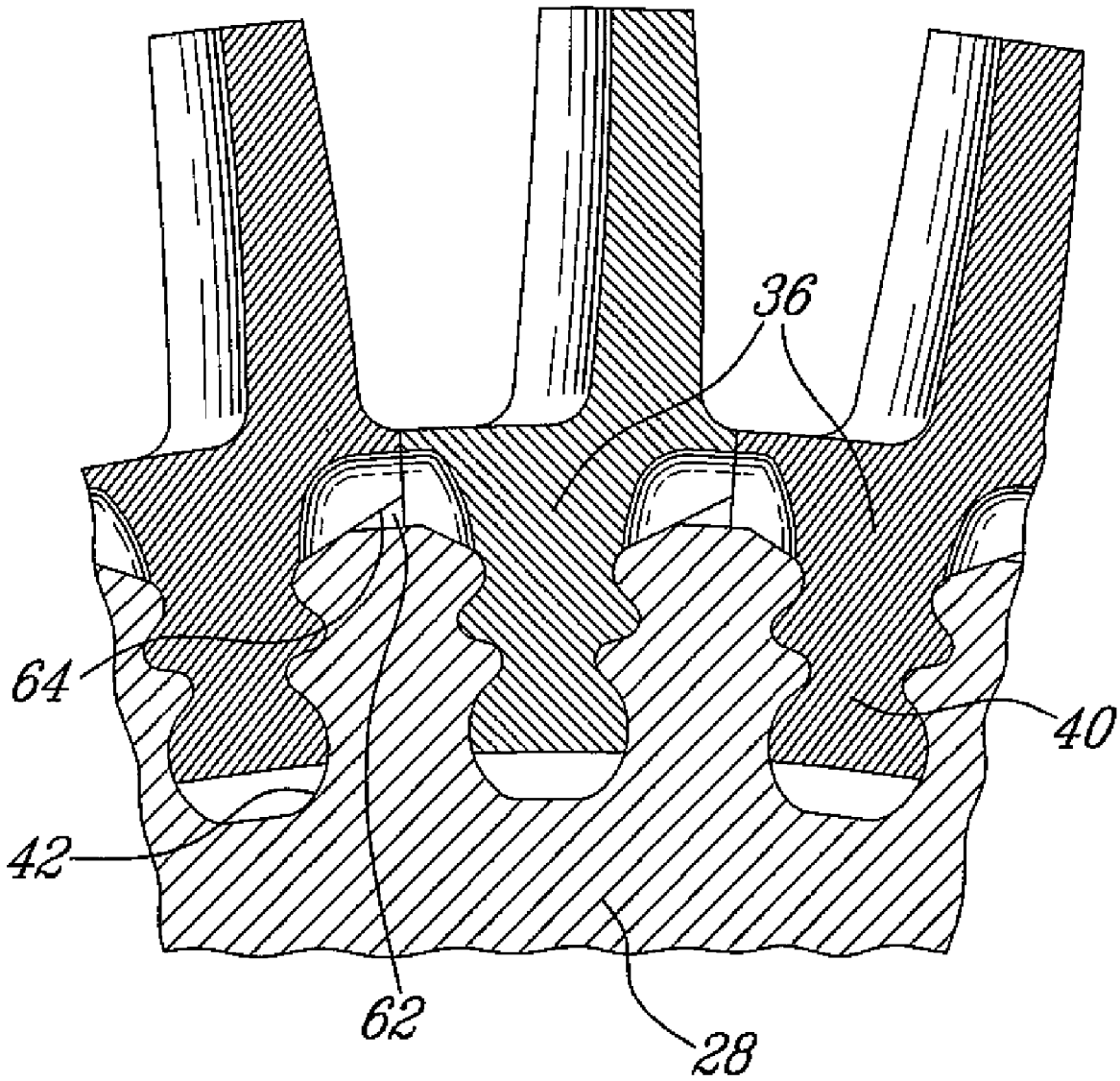
FIG. 4 is a cross-sectional front end view through two adjacent blade platforms showing an inter-blade cavity defined underneath the blade platforms.

As can be appreciated from FIGS. 3 and 4, the platform longitudinal side edge 50 of the one blade 30 interfaces the platform longitudinal side edge 52 of its adjacent blade 30. Inter-blade pocket or cavities 58 are thus formed between each adjacent pair of blade shanks 36 underneath the platforms 34. Each inter-blade cavity 58 is bounded by the undersurface 38 of left and right platform portions of adjacent blades 30, the shanks 36 of the adjacent blades 30 and by the peripheral land 60 left at the rim 44 of the disc 28 between each pair of adjacent blade receiving slots 42. The front or upstream end of each inter-blade cavity 58 is substantially closed off by the front circumferential lip on the rim 44 of the disc 28 and the left and right portions of the upstream platform rails 54 of adjacent platforms 34. Likewise, the downstream or rear end of each inter-blade cavity 58 is substantially closed off by the left and right portions of the downstream platform rails 56 of adjacent platforms 34.

Admission of cooling air into each inter-blade cavity 58 is controlled by an inlet opening 62 provided at the substantially closed front or upstream end of the cavity 58. By adjusting and selecting size of the inlet opening 62, it is possible to ensure that the pressure of the coolant flow admitted in the inter-blade cavities be greater than the pressure of the working fluid in the gaspath 24, thereby preventing hot gases migration into the inter-blade cavities 58 through the interspaces between adjacent blade platforms 34. As shown in FIG. 3, the inlet opening 62 can be provided, for instance, by machining away the left bottom corner portion 64 of the front platform rail 54 so as to create a gap area or slot between the blade 30 and the disc 28 at the interface of the front rails 54 of adjacent platforms 34. Alternatively, the rim 44 of the disc 28 could be machined to provide the required passages for metering a flow of cooling air into each of the inter-blade cavities 58. The inlet opening 62 or the gap may be provided by forming a cut-out portion in at least one of the opposed facing side edges of the front rails 54. The feature that allows cooling air to enter the inter-blade cavities 58 could be of any shape or form and can be created directly in the blade 30 or disc 28 by any suitable manufacturing technique.

The cooling flow to the inter-blade cavities 58 can be supplied by many means. For instance, as depicted by arrow 66 in FIG. 2, air bled from the compressor in order to cool the upstream row of vanes 20*a* can advantageously be recuperated to purge and cool the inter-blade cavities 58. The stator cooling flow 66 is directed through a cooling flow path defined in the inner vane support 68 and discharged into a leakage path 69 between the stator assembly 20*a* and the rotor assembly 22. The stator cooling flow 66 is combined, in the leakage path 69, with a rim seal purge flow 70 derived from tangential on board injector (TOBI) leakage or other suitable means. A controlled amount of the combined flows 66 and 70 is permitted to re-enter the gaspath 24 via a rim seal leakage path as depicted by arrow 72 so as to purge hot combustion gases that may have migrated into the area between the stator and rotor assemblies 20*a* and 22. The remainder of the coolant flows 66 and 70 is fed into the inter-blade cavities 58 through the front inlet openings 62 thereof as depicted by arrow 74. Another portion of the inter-blade cavity cooling flow can be provided by the cooling air leaking from between the disc front coverplate 76 and the disc 28, as represented by arrow 78. The coolant flows admitted into the inter-blade cavities 58 cool down the undersurface 38 of the platforms 34 as well as the rim 44 of the disc 28 while axially flowing from a front side of the disc to a rear side thereof.

Still referring to FIG. 2, a controlled amount of fluid from the cooling air flowing axially through the inter-blade cavities 58 is permitted to re-enter the gaspath 24 via the inter-platform space between opposed facing side edges 50 and 52 of adjacent platforms 34 (see arrow 80). The leakage flow 80 contributes to purge the inter-blade cavities 58 from any hot combustion gases that may have migrated from the gaspath 24 into the inter-blade cavities 58. It also contributes to prevent migration of hot gases from the gaspath into the cavities 58 through the interface of adjacent platforms 34. Thus, the leakage flow 80 creates a seal that substantially prevents the entry of the combustion gases from the gaspath 24 into the inter-blade cavities 58. Each inter-blade cavity 58 is in fluid flow communication with the clearance or interfacial gap existing between the roots 40 and the slots 42 of the associated blade fixing. This blade fixing clearance provides an outlet through which the coolant in the inter-blade cavities 58 can be discharged. As depicted by arrows 82, the portion of the coolant flow 74 which is not leaked out through the inter-platform gaps is leaked out through the trailing or rear edge portion of the blade fixing (that is between the blade roots 40 and the slots 42) into the leakage path 84 defined between the rotor assembly 22 and the downstream stator assembly 20*b*. At least a portion of the coolant flowing through the inter-blade cavities 58 may be discharged through a rear end of the slots 42 into the leakage path 84 provided at the rear of the disc 28. The coolant flow 80 is then used to supplement the purge flow of the downstream leakage path 84 before being reintroduced together with the purge flow into the gaspath 24, as shown by arrow 86.

The above described cooling scheme advantageously takes advantage of the cooling air which is already used to cool some of the stator and rotor components to cool and purge the inter-blade cavities 58. The use of the inter-blade cavity cooling flow to supplement the downstream leakage path between the rotor assembly 22 and the downstream stator assembly 20*b* also contributes to minimize the amount of coolant required to maintain the turbine components under acceptable temperatures.

The above description is meant to be exemplary only, and one skilled in the art will recognize that changes may be made to the embodiments described without departing from the scope of the invention disclosed. For example, a portion of the disc rim could be machined away to allow the cooling flow to enter the inter-blade pockets. Still other modifications which fall within the scope of the present invention will be apparent to those skilled in the art, in light of a review of this disclosure, and such modifications are intended to fall within the appended claims.

What is claimed is:

1. A turbine rotor comprising: a disc mounted for rotation about an axis, said disc having axially spaced-apart front and rear faces and a rim extending circumferentially between said front and rear faces; a circumferential array of turbine blades extending radially outwardly from the rim of the disc, each turbine blade having a platform, an airfoil portion extending from a gaspath side of the platform, and a root portion depending from an undersurface of the platform opposite the gaspath side, the root portion of each of the turbine blades being received in a corresponding slot defined in the rim of the disc, each pair of adjacent slots being separated by a peripheral land; and a circumferential array of inter-blade cavities defined between the undersurface of the platforms and the peripheral lands of the rim, each of the inter-blade cavities having a substantially closed upstream end in fluid flow communication with an inlet defined between the disc and the blades for channeling a flow of coolant from the front face to the rear face of the disc through said inter-blade cavities, wherein said inter-blade cavities are in fluid flow communication with corresponding ones of said slots defined in the rim of the disc, and wherein at least a first portion of the coolant flowing through the inter-blade cavities is discharged through a rear end of the slots.

2. The turbine rotor defined in claim 1, wherein a front rail extends radially downwardly from the undersurface of each of the platforms, the front rails of adjacent platforms having opposed facing side edges defining an interface, and wherein said inlet is provided at said interface.

3. The turbine rotor defined in claim 2, wherein said inlet is provided in the form of a gap created between said opposed facing side edges, at least one of the opposed facing side edges having a cut-out portion to provide said gap.

4. The turbine rotor defined in claim 1, wherein each pair of adjacent platforms defines an inter-platform space, and wherein a second portion of the coolant flowing through said inter-blade cavities is allowed to leak through said platform interspaces.

5. A turbine section of a gas turbine engine comprises a forward stator assembly and a rotor assembly; the rotor assembly having a disc mounted for rotation about an axis and a plurality of circumferentially distributed blades extending radially outwardly from the disc into a working fluid gaspath; a front leakage path leading to the working fluid gaspath defined between the forward stator assembly and the rotor assembly; each blade being provided with a platform having an undersurface disposed in opposed facing relationship with a radially outwardly facing rim surface of the disc; and inter-blade cavities defined between the undersurface of the platforms of adjacent blades and the radially outwardly facing rim surface of the disc, each of the inter-blade cavities having a substantially closed upstream end with an inlet in fluid flow communication with the front leakage path for admitting a restricted portion of a coolant flow fed into the front leakage path into the inter-blade cavities, and an outlet for discharging the coolant flow passing through the inter-blade cavities in at least one of the working fluid gaspath and a rear side of the rotor assembly, wherein each blade has a root captively received in a slot defined in the radially outwardly facing rim surface of the disc, and wherein the inter-blade cavities are in fluid flow communication with corresponding ones of said slots, a portion of the coolant flowing through the inter-blade cavities is discharged through a rear end of the slots into a rear leakage path provided on a rear side of the disc, the rear end of the slots forming another part of the outlet of the inter-blade cavities.

6. The turbine section defined in claim 5, wherein the forward stator assembly has an inner vane support, the inner vane support defining a cooling flow path leading to said front leakage path, and wherein at least part of the coolant flow channeled through the inter-blade cavities is fed through the inner vane support via the cooling flow path.

7. The turbine section defined in claim 6, further comprising means for directing a purge flow through said front leakage path, the purge flow and the coolant flow from the inner vane support mixing together in said front leakage path upstream of the inlets of said inter-blade cavities.

8. The turbine section defined in claim 6, wherein a front coverplate is mounted to a front face of the disc, the front coverplate and the front face of the disc defining therebetween a front disc cooling passage having a leakage zone at a periphery of said front coverplate, said leakage zone being in fluid flow communication with the inlets of said inter-blade cavities.

9. The turbine section defined in claim 5, wherein the outlet of each of the inter-blade cavities comprises an inter-platform space between opposed facing side edges of each pair of adjacent platforms.

10. The turbine section defined in claim 5, wherein said outlet is in fluid flow communication with a rear leakage path provided on a rear side of the disc, the coolant flow discharged from the inter-blade cavities into the rear leakage path acting as a purge flow to prevent hot gases flowing through the working fluid gas path from migrating into the rear leakage path.

11. The turbine section defined in claim 10, wherein a front rail extends radially downwardly from the undersurface of each of the platforms, the front rails of adjacent platforms having opposed facing side edges defining an interface, and wherein said inlet is provided at said interface.

12. The turbine section defined in claim 11, wherein said inlet is provided in the form of a gap created between said opposed facing side edges, at least one of the opposed facing side edges having a cut-out portion to provide said gap.

13. A method of cooling a turbine section having a stator assembly disposed to direct a flow of hot gases to a rotor assembly having a series of blades extending radially outwardly from a rotor disc into a gaspath of said hot gases, said blades having platforms defining a radially inner boundary of the gaspath, wherein each blade has a root captively received in a slot defined in a radially outwardly facing rim surface of the rotor disc, the method comprising: providing a first cooling flow to purge a first space between the stator assembly and the rotor assembly from said hot gases, providing a second cooling flow to cool said stator assembly, cooling the platforms and the rim surface of the rotor disc by directing a combined portion of said first and second cooling flows from a front side of said disc to a rear side thereof through inter-blade cavities defined between an undersurface of the platforms and the periphery of the rotor disc, and discharging at least a first portion of the combined portion of the first and second cooling flows through a rear end of the slots.

14. The method defined in claim 13, further comprising using at least a portion of the cooling flow passing through the inter-blade cavities to supplement a third cooling flow purging a second space on the rear side of the rotor disc.

15. The method defined in claim 13, further comprising leaking a second portion of the cooling flow passing through the inter-blade cavities into the gaspath through gaps between the platforms of adjacent blades.

* * * * *